United States Patent [19]
Cann et al.
[11] 4,318,277
[45] Mar. 9, 1982

[54] NON-REVERSE HOT GAS DEFROST SYSTEM

[75] Inventors: Peter L. Cann, Canastota; Richard J. Duell; Donald J. Casler, both of Syracuse, all of N.Y.

[73] Assignee: Carrier Corporation, Syracuse, N.Y.

[21] Appl. No.: 159,521

[22] Filed: Jun. 16, 1980

Related U.S. Application Data

[62] Division of Ser. No. 947,361, Oct. 2, 1978, Pat. No. 4,246,760.

[51] Int. Cl.[3] ..... F25B 47/00
[52] U.S. Cl. ..... 62/278
[58] Field of Search ..... 62/81, 155, 197, 278, 62/160, 196 B, 196 R, 324.6, 503; 165/14

[56] References Cited

U.S. PATENT DOCUMENTS

| | | | |
|---|---|---|---|
| 2,440,146 | 4/1948 | Kramer | 62/155 |
| 2,564,310 | 8/1951 | Nussbaum et al. | 62/196 |
| 3,167,930 | 2/1965 | Block et al. | 62/190 X |
| 3,209,814 | 10/1965 | Block | 165/14 |
| 3,677,025 | 7/1972 | Payne | 62/81 |
| 4,122,688 | 10/1978 | Mochizuki et al. | 62/196 R |

*Primary Examiner*—Lloyd L. King
*Attorney, Agent, or Firm*—J. Raymond Curtin; Robert P. Hayter

[57] ABSTRACT

A method and apparatus utilizing a hot gas defrost system wherein superheated gas from the system compressor is conducted into a heat exchanger mounted within an accumulator for supplying heat to vaporize liquid refrigerant received from the evaporator. After the gas passes through the heat exchanger it is conducted to the condenser where it is condensed to a liquid and then routed to the evaporator. In the evaporator or frost accumulating coil the liquid refrigerant is subcooled, supplying heat to melt the ice formed on the evaporator surfaces and the liquid is thereafter conducted to the accumulator where the heat supplied from the heat exchanger acts to vaporize the fluid. The vaporized refrigerant is then recycled to the compressor to complete the system.

3 Claims, 2 Drawing Figures

NON-REVERSE HOT GAS DEFROST SYSTEM

This is a division of application Ser. No. 947,361, filed Oct. 2, 1978, now U.S. Pat. No. 4,246,760.

BACKGROUND OF THE INVENTION

1. Field of the Invention

This invention relates in general to refrigeration circuits and more particularly to a defrost system for use in a refrigeration circuit such as may be incorporated in air conditioning apparatus including a heat pump.

2. Prior Art

The conventional refrigeration circuit employs a compressor, condenser, expansion means and evaporator connected to form a refrigerant flow circuit. The compressor raises the pressure and temperature of gaseous refrigerant and the gaseous refrigerant is then conducted to the condenser wherein it gives off heat to a cooling fluid and is condensed to a liquid. This liquid refrigerant then flows through an expansion means such that its pressure is reduced and it is therefore capable of changing from a liquid to a gas, absorbing heat during the change in state. A complete change of state from a liquid to a gas occurs in the evaporator and heat is removed from the media flowing in heat transfer relation with the evaporator. The gaseous refrigerant from the evaporator is then conducted back to the compressor.

Under appropriate ambient conditions the media flowing in heat transfer relation with the evaporator, typically air, has its temperature lowered below its dew point. Once the temperature of the air is below the dew point, moisture is deposited on the coil surfaces resulting in a collection of fluid thereon, of if the ambient conditions are sufficiently low or the temperature of the evaporator is sufficiently low, ice is formed thereon. Once this ice or frost coats the surfaces of the heat exchanger the efficiency of the heat exchanger is impaired and overall system efficiency decreases. Consequently, it is desirable to maintain the evaporator surfaces free from ice or frost.

The formation of ice or frost on the heat exchanger surface is particularly acute with heat pumps used to provide heating to an enclosure. In operation of the heat pump in the heating mode the outdoor coil functions as an evaporator such that heat may be absorbed from the outside air. If the outside air is at a low temperature the evaporator must operate at an even lower temperature and consequently it may operate under the appropriate environmental conditions such that ice and frost are formed thereon.

Many systems have been developed for defrosting heat exchanger coils. These include supplying electric resistance heat to the coil surface to melt the ice and reversing a refrigeration system such that hot gas discharged from the compressor is circulated through the evaporator to melt the ice thereon. An inconvenience accompanying the reversing system is that heat is removed from the enclosure being heated during defrost.

Many non-reverse defrost systems i.e. systems which do not involve a reversal in the flow path of refrigerant through the refrigeration circuit, have been previously utilized and are disclosed in the art. Most of these systems however do not involve using liquid refrigerant to melt the ice on the heat exchanger in question. Most of these systems concern bypassing the condenser such that hot gas from the compressor is discharged directly into the evaporator and then some method is used to vaporize the refrigerant which is liquified in the exchanger or to maintain superheat in the refrigerant so that it never changes from a gas to a liquid. Herein the liquid refrigerant is subcooled in the evporator such that the amount of heat given off to the heat exchanger to melt the ice formed thereon is a function of the temperature difference between the fluid entering the heat exchanger and the fluid being discharged from the heat exchanger.

In the present non-reversible hot gas defrost system superheated gaseous refrigerant is conducted in the defrost mode of operation to a heat exchanger mounted within an accumulator disposed between the evaporator and the compressor such that the hot gas discharged from the compressor circulates through the heat exchanger and then to the condenser. In the heat exchanger gaseous refrigerant changes state to a liquid and then is conducted through the condenser which is rendered inoperative for heat transfer to the evaporator where the liquid is further condensed and subcooled, melting the ice formed thereon. The liquid refrigerant being discharged from the evaporator is then conducted to the accumulator which partially fills with liquid refrigerant. The compressor suction line runs into the top portion of the accumulator such that gaseous refrigerant may be withdrawn therethrough while leaving liquid refrigerant within the accumulator. By supplying hot gas to the accumulator heat exchanger during defrost, heat energy is provided to vaporize the liquid refrigerant within the accumulator. By a combination of the vaporization of the liquid refrigerant and the decrease in pressure created by the suction of the compressor sufficient gaseous refrigerant is provided to supply the system. The condensing subcooling effect of the liquid refrigerant within the evaporator provides sufficient heat to melt the frost or ice formed on the surfaces of the heat exchanger.

SUMMARY OF THE INVENTION

It is an object of this invention to improve systems for removing the accumulation of frost or ice on a heat exchanger coil.

Another object of the present invention is to assure return gaseous refrigerant to the compressor notwithstanding that liquid refrigerant is cycled through the evaporator.

A further object of this invention is to increase heat transfer efficiency through removal of frost and ice from a heat exchanger coil and to return gaseous refrigerant for use in the system.

Still another object of this invention is to remove accumulated frost or ice from the outdoor coil of the heat pump without withdrawing heat from the air to be conditioned to effect defrosting.

Another object of the present invention is to subcool a liquid refrigerant within the coil to be defrosted to provide heat to melt the ice thereon.

It is another object of the present invention to provide an accumulator and a heat exchanger such that refrigerant flow is through the heat exchanger during defrost and directed directly to the compressor during normal operation.

Other objects will be apparent from the description to follow in the appended claims.

These and other objects are attained in accordance with the present invention wherein there is provided a hot gas defrost system such that during heat transfer refrigeration operations compressor discharge gas is conducted to the condenser where it changes state to a liquid, then through an expansion means to the evaporator where it changes state from a liquid to a gas absorbing heat from the media in heat transfer relation therewith, and then is conducted into an accumulator from which the compressor draws gaseous refrigerant to complete the cycle. During defrost, valve mechanisms are actuated to reroute the refrigerant being discharged from the compressor through a heat exchanger located within the accumulator prior to the gaseous refrigerant being conducted to the condenser. The refrigerant from the heat exchanger is then conducted through the inactive condenser to the evaporator where it changes state to a liquid and is subcooled melting the ice formed thereon. The liquid refrigerant is then discharged into the accumulator in heat exchange relation with the hot gas passing through the heat exchanger. This hot gas acts to vaporize the refrigerant within the accumulator providing a source of gaseous refrigerant for the compressor.

DESCRIPTION OF THE PREFERRED EMBODIMENT

The embodiment described herein will apply to a system designed to provide cooling to an enclosure. The invention herein has like applicability to reversible refrigeration systems known as heat pumps and to other types of refrigeration equipment wherein ice is formed on a heat exchanger coil such as in refrieration units used in low temperature application, i.e. transporation equipment, cold room, etc. This invention might have like applicability to dehumidifiers and other cooling type apparatus.

Figure 1:
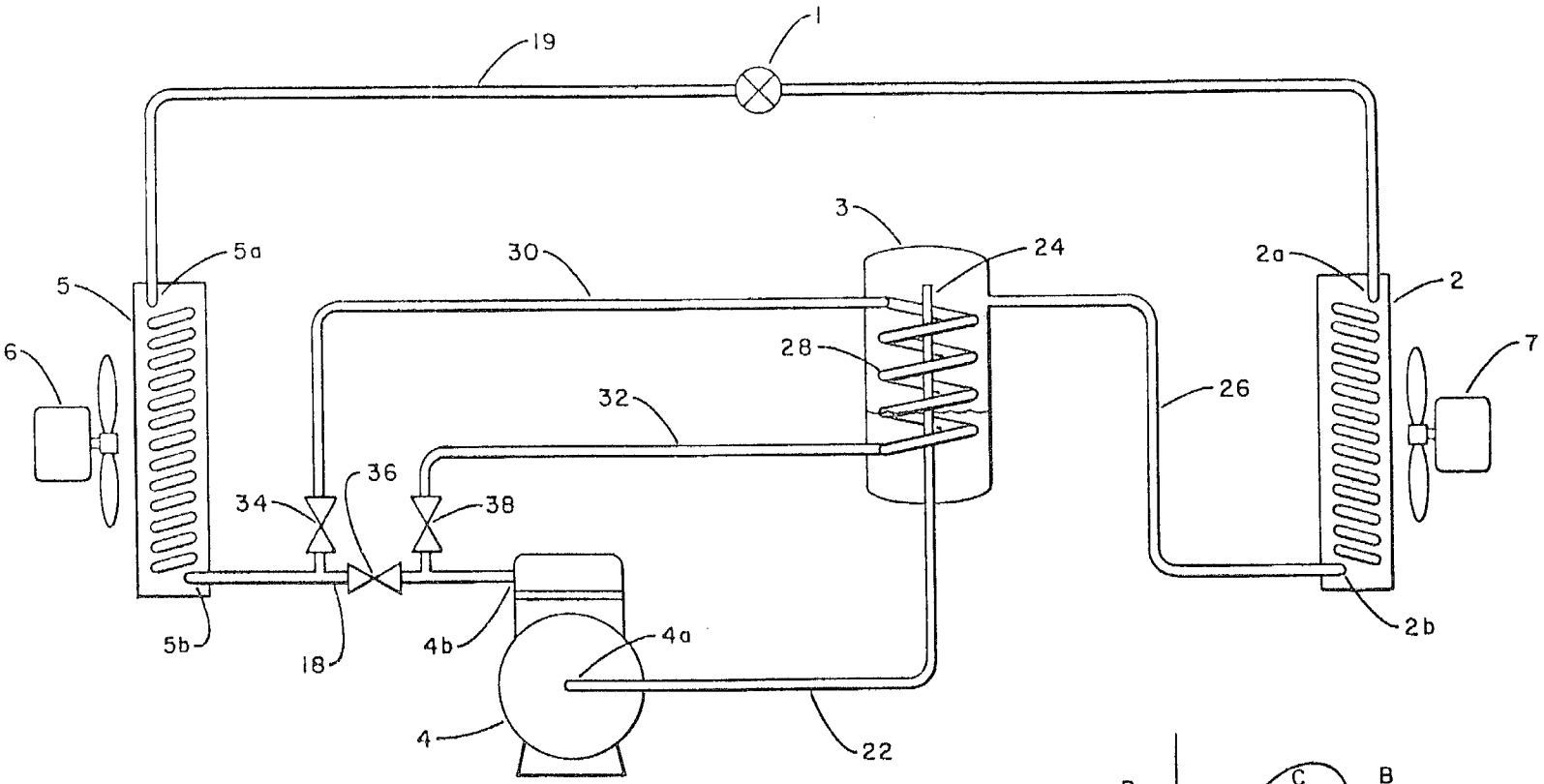
FIG. 1 schematically illustrates the hot gas defrost system serving as the subject of this invention as it applies to an air cooling application.

Referring now to the drawings, it can be seen in FIG. 1 that compressor 4 is mounted to discharge gaseous refrigerant through compressor outlet 4B into conduit 18. This gaseous refrigerant flows through valve 36 in conduit 18 to condenser 5. Gaseous refrigerant enters the condenser at inlet 5B and is discharged as a liquid refrigerant at outlet 5A. Condenser fan 6 is mounted to circulate outdoor air in heat exchange communication with the condenser such that heat may be absorbed from the refrigerant. From condenser outlet 5A liquid refrigerant travels through conduit 19 to expansion means 1. At expansion means 1 pressure is dropped such that the liquid refrigerant may be flashed to form a partially gaseous refrigerant. The refrigerant is conducted from expansion means 1 to evaporator 2 at evaporator inlet 2A. Within the evaporator the gaseous refrigerant changes state from a liquid to a gas absorbing heat from the air circulating in heat exchange communication therewith. Evaporator fan 7 acts to circulate air from the enclosure to be conditioned over with the evaporator such that the air is lowered in temperature. The gaseous refrigerant exits the evaporator through outlet 2B and travels through conduit 26 to accumulator 3. Compressor suction line 22 draws the gaseous refrigerant from within the top portion of accumulator 3 into compressor inlet 4A to complete the refrigeration cycle.

It can be also seen on FIG. 1 that valve 38, conduit 32, heat exchanger 28, conduit 30 and a valve 34 all arranged so that during defrost hot gas being discharged from compressor outlet 4B may be cycled through these components such that the hot gas discharged from the compressor is in heat exchange communication with the refrigerant in accumulator 3.

OPERATION

During defrost the hot gas discharge from compressor 4B flows through open valve 38, since valve 36 is now in the closed position, and through conduit 32 to heat exchanger 28. This superheated gas gives off some of its heat through heat exchanger 28 to the refrigerant contained within accumulator 3. The desuperheated and condensed refrigerant then travels through conduit 30 through open valve 34 to condenser inlet 5B. The refrigerant passes through condenser 5 which is rendered inoperative for heat transfer by not energizing fan motor 6 and then travels to evaporator inlet 2A. Within the evaporator the same refrigerant is further condensed and subcooled giving up heat to melt the ice formed on the evaporator coil. During defrost evaporator fan 7 is not operated such that there is no heat exchange between the air to be conditioned and evaporator 2. Subcooled refrigerant then exits thru evaporator outlet 2B and travels through line 26 to accumulator 3. Liquid refrigerant is collected in the bottom of accumulator 3 and gaseous refrigerant at the top. Conduit 22 is connected to gas inlet 24 such that gaseous refrigerant may be removed from the top of the accumulator to supply the compressor at compressor inlet 4A. Heat is supplied thru heat exchanger 28 to the liquid refrigerant contained within accumulator 3 from the hot discharge gas from compressor. This heat exchange relation acts to vaporize a portion of the liquid refrigerant within the accumulator to provide a supply of gaseous refrigerant for the compressor.

Figure 2:
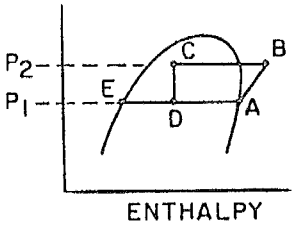
FIG. 2 is a pressure enthalpy diagram depicting the refrigerant cycle as shown in FIG. 1.

Referring now to FIG. 2, a pressure enthalpy diagram of the refrigerant system shown in FIG. 1, it can be seen that during compression within the compressor refrigerant moves from a pressure of $P_1$ at point A to a pressure level of $P_2$ at point B. FIG. 1 is marked with letters A through E corresponding to the same letters on the pressure enthalpy diagram of FIG. 2. The pressure of the refrigerant does not change as it travels from the compressor discharge, point B to the expansion device at point C. This pressure level is maintained in what is known as the high side of the refrigerant circuit. As the refrigerant travels from point B to point C and it may give up its super heat and be partially condensed within the interchanger 28. The pressure of the refrigerant is reduced at expansion means 1 from C to D indicated by the difference from pressure level $P_2$ to pressure level $P_1$. The liquid refrigerant enters the evaporator at point D on the graph indicated by letter D on FIG. 1. This refrigerant is then further condensed and subcooled during defrost in evaporator 2 such that saturated liquid may exit the evaporator at point E as shown on the pressure enthalpy diagram. The distance between points D and E is related to the amount of heat energy given up in evaporator 2 to melt the ice formed thereon. The liquid refrigerant enters the accumulator at point E and has heat supplied thereto from the interchanger 28 such that it travels to point A to complete the cycle. From point A the refrigerant then can be compressed traveling from pressure level $P_1$ to pressure level $P_2$ and point B.

This refrigerant cycle is the same as the standard refrigerant cycle except for the subcooling provided in the evaporator to melt the ice formed thereon. In a standard refrigeration circuit the refrigerant must travel from point D to point A with the pressure enthalpy diagram indicating a change in state from a mixture of liquid and gas to an entirely gaseous situation. The left most line of the curve of the pressure enthalpy diagram indicates a saturated liquid state and the right most line indicates a saturated gaseous state. Consequently any location between the two lines indicates a mixture of gas and liquid and any location to the left of the left line indicates all liquid and any location right of the right hand line indicates a complete gaseous state.

Consequently there has been provided herein a non-reverse hot gas defrost system wherein liquid refrigerant is further condensed and subcooled in the evaporator to supply heat for melting ice formed thereon. The pressure enthalpy diagram enclosed herein indicates heat energy may be utilized to provide for defrost under these conditions.

The invention has been described herein with particular reference to the embodiment of FIG. 1. It is to be understood by those skilled in the art that various changes may be made and equivalent substituted for the elements thereof without departing from the scope of the invention. In addition, many modifications may be made to adapt to a particular situation or material to the teachings of the invention without departing from the essential scope thereof. Therefore it is intended that the invention not be limited to the particular embodiment disclosed as the best mode contemplated for carrying out the invention, but that the invention will include all embodiments falling without the scope of the appended claims.

What is claimed is:

1. A refrigeration system having a cooling mode of operation and a defrost mode of operation wherein heat energy is transferred from refrigerant to the evaporator to melt ice formed thereon which comprises:

a compressor including a compressor outlet and a compressor inlet;

a condenser including a condenser inlet and a condenser outlet;

an evaporator including an evaporator inlet and an evaporator outlet;

means connecting the condenser outlet to the evaporator inlet;

an accumulator having an accumulator inlet connected to the evaporator outlet and an accumulator outlet connected to the compressor inlet;

a heat exchanger mounted within the accumulator and including a supply conduit for supplying refrigerant to the heat exchanger and a discharge conduit for directing refrigerant from the heat exchanger; and routing means connected between the supply conduit, discharge conduit, condenser inlet and compressor outlet for directing refrigerant directly from the compressor outlet to the condenser inlet in the cooling mode and for directing refrigerant from the compressor outlet through the supply conduit, heat exchanger and discharge conduit to the condenser inlet in the defrost mode of operation whereby heat energy is supplied in the defrost mode from the refrigerant flowing through the heat exchanger to refrigerant in the accumulator.

2. The apparatus as set forth in claim 1 and further comprising a condenser fan for circulating air in heat exchange relation with the condenser and an evaporator fan for circulating air in heat exchange relation with the evaporator; and means for preventing operation of the evaporator fan and condenser fan during the defrost mode of operation to reduce heat transfer between the refrigerant flowing through the evaporator and condenser and air flowing thereover.

3. The apparatus as set forth in claim 1 wherein the routing means includes valve means for directing the refrigerant flow either directly from the compressor outlet to the condenser inlet or through the heat exchanger as the refrigerant flows from the compressor outlet to the condenser inlet.

* * * * *